US005178069A

United States Patent [19]

Rodi

[11] Patent Number: 5,178,069

[45] Date of Patent: Jan. 12, 1993

[54] PROTECTIVE DEVICE FOR OFFSET ROTARY PRINTING MACHINES

[75] Inventor: Anton Rodi, Leimen, Fed. Rep. of Germany

[73] Assignee: Heidelberger Druckmaschinen AG, Heidelberg, Fed. Rep. of Germany

[21] Appl. No.: 574,436

[22] Filed: Aug. 28, 1990

[30] Foreign Application Priority Data

Sep. 12, 1989 [DE] Fed. Rep. of Germany ..... 3930364

[51] Int. Cl.[5] ..... B41L 30/00

[52] U.S. Cl. ..... 101/480; 101/216; 400/690; 400/690.1; 400/690.4

[58] Field of Search ..... 100/53; 400/690, 690.1, 400/690.2, 690.4; 101/480, 216, 424

[56] References Cited

U.S. PATENT DOCUMENTS

| | | | |
|---|---|---|---|
| 3,308,919 | 3/1967 | Cunningham | 400/690 |
| 3,601,045 | 8/1971 | Schinke et al. | 101/148 |
| 4,000,693 | 1/1977 | Kaiser et al. | 101/182 |
| 4,054,064 | 10/1977 | Walker | 100/53 |
| 4,106,607 | 8/1978 | Badavas | 192/129 B |
| 4,463,049 | 1/1983 | Kracke | 428/281 |
| 4,541,203 | 8/1983 | Naffrechoux et al. | 49/485 |
| 4,626,048 | 12/1986 | Goodlander | 400/691 |
| 4,631,461 | 12/1986 | Peugeot | 49/28 |
| 4,669,380 | 6/1987 | Seib et al. | 101/216 |
| 4,621,454 | 11/1986 | Halstead | 49/386 |
| 4,711,172 | 12/1987 | Capdeboac | 101/152 |
| 4,714,010 | 12/1987 | Smart | 98/115.4 |
| 4,726,699 | 2/1988 | Buschmann et al. | 400/690 |
| 4,854,233 | 8/1989 | Despot et al. | 101/216 |
| 5,012,729 | 5/1991 | Slot | 100/53 |

FOREIGN PATENT DOCUMENTS

| | | | |
|---|---|---|---|
| 0238802 | 9/1987 | European Pat. Off. | 400/690 |
| 2258640 | 6/1974 | Fed. Rep. of Germany | 101/216 |
| 8215605 | 5/1982 | Fed. Rep. of Germany . | |
| 3115475 | 11/1982 | Fed. Rep. of Germany . | |
| 3615978 | 11/1986 | Fed. Rep. of Germany . | |
| 3539290 | 4/1987 | Fed. Rep. of Germany | 400/689 |
| 2546104 | 11/1984 | France | 400/690 |
| 2582989 | 12/1986 | France . | |
| 2115272 | 9/1983 | United Kingdom | 400/690 |

OTHER PUBLICATIONS

Zeller, Warner; "The Sound-Insulation of Sound Sources" *Technische Larmahwehr*; pp. 104–119.

Lotze, E.; "Autoren Kollektiv"; *Larmbekampfung*; pp. 411–427.

Schoppner, Horst; "Possibilities of Technical Noise"; *Drunk Print.*

*Primary Examiner*—Edgar S. Burr

*Assistant Examiner*—John S. Hilten

*Attorney, Agent, or Firm*—Nils H. Ljungman and Associates

[57] ABSTRACT

The invention relates to a protective device for offset rotary printing machines, in particular for printing units of sheet-fed rotary printing machines, with a sheet-like protective covering of the danger points, which is designed in such a way that sound protection for the printing units is achieved without adversely affecting easy accessibility for adjustment setting and service purposes.

9 Claims, 4 Drawing Sheets

PROTECTIVE DEVICE FOR OFFSET ROTARY PRINTING MACHINES

BACKGROUND OF THE INVENTION

1. Field of the Invention

The invention relates to a protective device for offset rotary printing machines, in particular for printing units of sheet-fed rotary printing machines, with a sheet-like protective covering of the danger areas. The protective device is preferably positioned so that it can be removed for adjustment and maintenance work. It is also preferably protected by electrical fuse circuits.

2. Background Information

In a known design of this type (DE-OS 31 15 475), protective coverings are provided in the area of the printing unit cylinder in order to prevent the operator from unintentionally gaining access to danger areas, such as to the intake gap of the printing unit cylinder. Protective coverings of this type are generally required in large numbers for a modern multicolor printing machine. As a result, operational expenditure increases, the accessibility of the machine often suffers and the appearance of the machine is generally not improved. When taking into account the fact that modern printing machines continue to display greater degrees of automation, especially in the realm of printing units, the ratio between the expenditure on protective devices and their benefit in practical use becomes less and less favorable.

OBJECT OF THE INVENTION

It is the object of the invention to improve protection means for a printing machine, such as an offset rotary printing machine, and, at the same time, to create sound insulation for the printing units. In accomplishing this objective, it is also desired to enable ease of access to the printing machine for adjustment and maintenance purposes.

SUMMARY OF THE INVENTION

The object of the present invention is accomplished by the fact that the protective device preferably surrounds the printing units in the form of a capsule. Additionally, the protective device is preferably designed to be totally or partially removable in order to carry out adjustment or maintenance work. One advantage of the provided solution is that the sound created by the printing units can be considerably reduced at the installation location of the machine. In addition, only one protective device is required as a result of the solution described, thus, the expenditure is reduced in comparison to the known designs.

In other words, the capsule-like structure of the present invention should aid considerably in absorbing a substantial part of the sound created by the printing machine within. Additionally, the provision of just one larger protective device, as is preferred by the present invention, can represent a great reduction in cost as compared to the provision of a number of smaller protective devices.

Furthermore, the printing units can be built more compactly in the case of multicolor machines, so that the protective and sound insulation measures do not have a negative effect. It is particularly advantageous to make the walls of the protective device out of sound-reducing material.

Under special circumstances, according to an advantageous embodiment of the invention, it is possible to form the protective device from a number of individual structural elements, which are mounted so that they can be moved or swivelled against one another. In a closed state, these individual elements can be sealed with gaskets. This arrangement of individual structural elements guarantees high flexibility of the protective device in practical operation.

In a further embodiment of the present invention, the capsular protective device is preferably mounted so that it can be lifted off or swivelled, and so that the entire device and/or its individual elements can be protected by electrical fuse circuits. Moreover, the capsular protective device is provided with an extraction device to carry off vapors and heat created in the printing units so that environmental protection measures may be implemented simply and effectively in addition to sound insulation. Thus, in the case of an air recirculation system, it is possible, for example, to additionally afford cooling of the printing units. Dry fresh air may also be fed in so as to dry the printed material having imprinted ink and to remove the solvent.

It will be seen that additional features of the invention, as detailed below, facilitate the practical handling of the protective device and yield advantages for both the machine and the operator.

One aspect of the invention resides broadly in an offset rotary printing machine having at least one printing unit and having a protective covering of at least some danger areas of the at least one printing unit; the protective covering comprising substantially flat surfaces; the protective covering for being removable for adjustment and maintenance work; the protective covering surrounding the at least one printing unit for substantially encapsulating the at least one printing unit; the protective covering being protected by at least one of; safety disconnecting circuitry for disconnecting electric power to the printing machine and electrical fuse circuitry; and the protective covering having apparatus for at least partially opening the protective covering for carrying out adjustment and maintenance work on the at least one printing unit.

Another aspect of the invention resides broadly in a protective covering for an offset rotary printing machine, wherein the printing machine has at least one printing unit; the protective covering being provided for covering at least some danger areas of the at least one printing unit; the protective covering comprising substantially flat surfaces; the protective covering for being removable for adjustment and maintenance work; the protective covering surrounding the at least one printing unit for substantially encapsulating the at least one printing unit; the protective covering being protected by at least one of: safety disconnecting circuitry for disconnecting electric power to the printing machine and electrical fuse circuitry; and the protective covering having apparatus for at least partially opening the protective covering for carrying out adjustment and maintenance work on the at least one printing unit.

BRIEF DESCRIPTION OF THE DRAWINGS

The disclosure now turns to a detailed description of the preferred embodiments of the invention, after first briefly describing the accompanying drawings, wherein.

DESCRIPTION OF THE PREFERRED EMBODIMENTS

Figure 1:
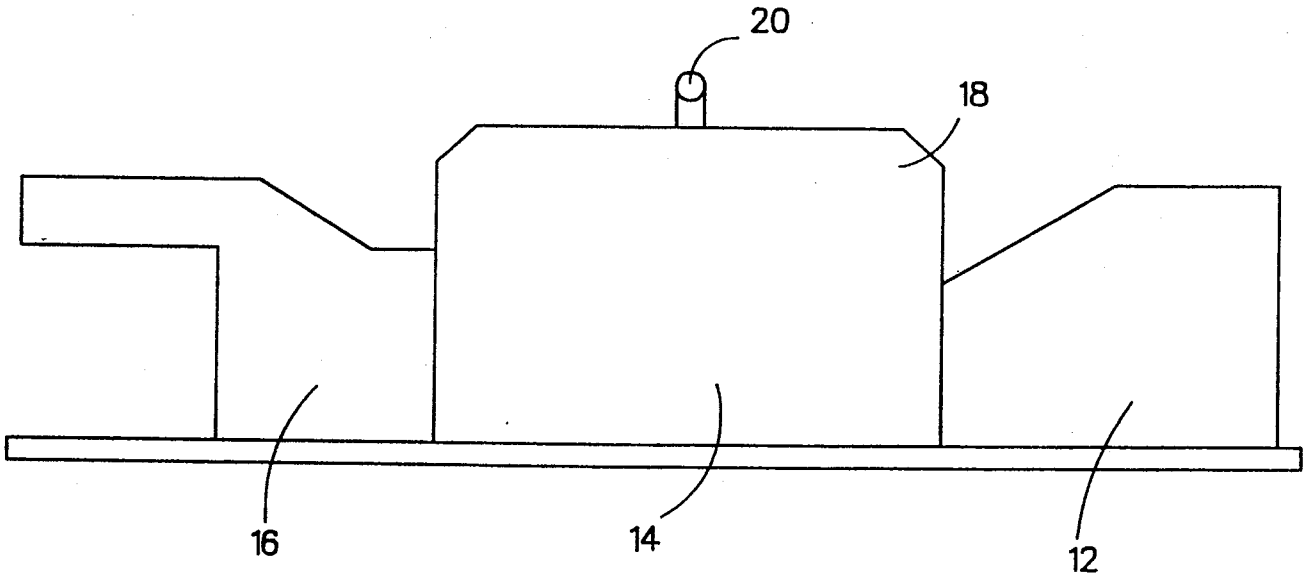
FIG. 1 is a schematic elevational view of a rotary offset printing machine assembly and a preferred protective device disposed thereabout.

The schematically drawn view of a sheet-fed rotary printing machine shown in FIG. 1 shows a feeder 12, one or more printing units 14, and a delivery unit 16. The printing units 14 are surrounded in the constructional version shown by a protective device 18, which is designed in capsule form and preferably comprises sound-reducing material. The protective device 18, which entirely surrounds the printing units, may be formed of a number of individual elements 24 (See FIG. 2) which elements may be mounted so as to be movable or swivellable in relation to one another. The individual elements are mutually sealed in the closed state, so that the injurious vapours created in the printing units can be extracted by means of an extractor device 20. In the same way, instead of an extraction device, an air recirculation system 32 (See FIG. 2) for cooling the printing units 14, as well as for removing injurious vapors, may be connected to the protective device 18. The advantageous developments according to the dependent claims may be implemented in a purely mechanical manner in practice.

Figure 1A:
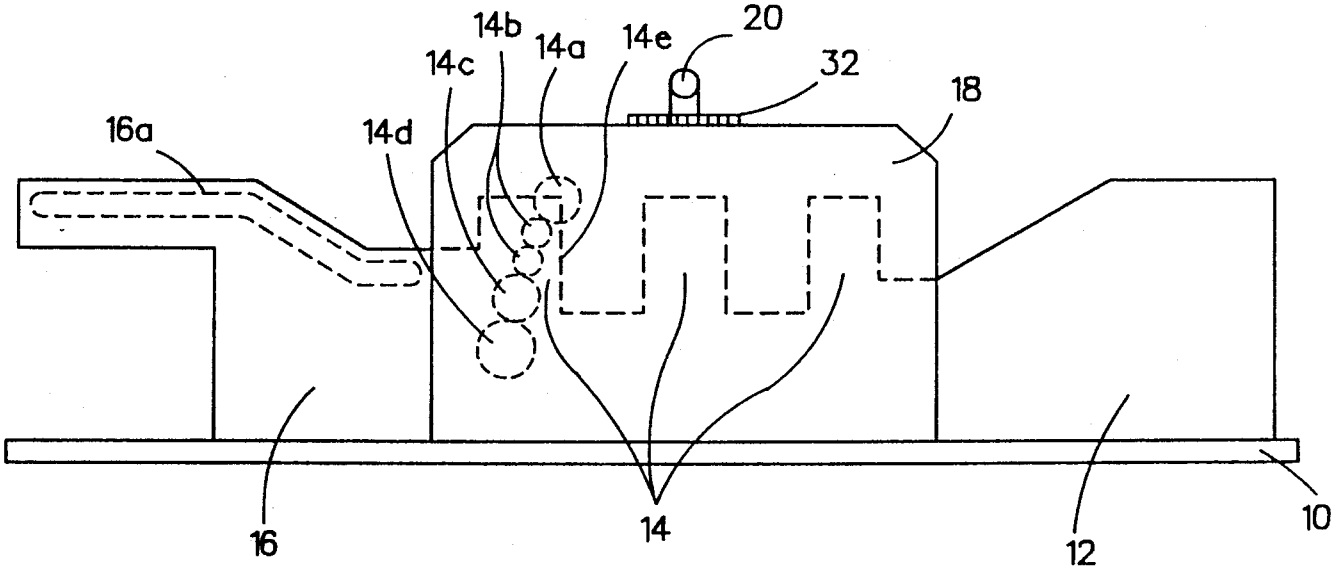
FIG. 1*a* is substantially the same view as FIG. 1, but showing in more detail various components of the present invention.

FIG. 1*a* shows the above-mentioned printing assembly, which may be an offset rotary printing machine assembly, as may be found on a floor 10 of a print shop. Disposed in a linear arrangement and progressing from one end of the assembly to the opposite end are the feeder unit 12, the arrangement of printing units 14 and the delivery unit 16. Typically, each printing unit 14 includes ink duct roller 14*a*, ink transfer rollers 14*b*, blanket cylinder 14*c* and impression cylinder 14*d*, each of which are mounted for rotation in support frame 14*e*. Also, delivery unit 16 typically includes a sheet conveyor 16*a*. The printing units 14 are preferably disposed within the protective device 18, which device is in the form of a capsular structure. It may be seen that the protective device 18 preferably surrounds, and therefore houses, the printing units 14 in such a way that, notwithstanding aspects of the protective device 18 to be disclosed further below, physical access to the printing units 14 is substantially impeded. Additionally, it should be understood that the protection device 18 is not necessarily affixed to the printing units 14, and may in fact be supported from the floor 10 of the print shop. Preferably disposed upon the roof of the protective device 18 is the extractor device, or ventilation unit 20.

Figure 2:
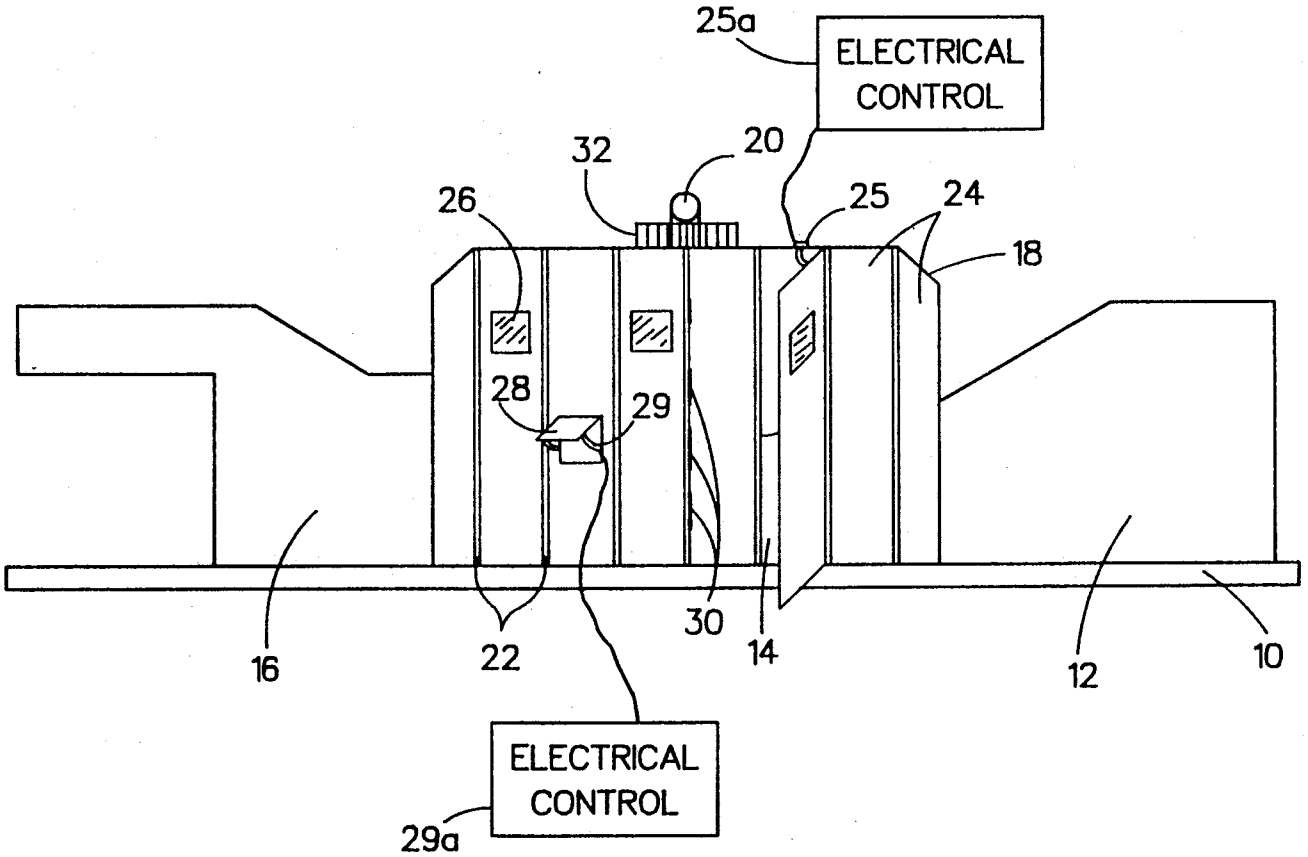
FIG. 2 is substantially the same view as FIGS. 1 and 1*a*, but showing in detail a set of components disposed upon the protective device.

FIG. 2 shows the printing assembly, in which the protective device 18 is provided with a set of components included in the present invention. The protective device 14 preferably comprises a structural frame with vertical supports 22. Preferably disposed upon the frame are a number of smaller structural elements 24, which structural elements may be in the form of swivellable panels. As an example, such a swivellable panel may be hinged upon the vertical supports 22 of the structural frame. In this way, complete operator access may be afforded to substantially every section of the arrangement of printing units 14.

Means for holding the swivellable panels 22 in a closed position on the vertical supports 22 may include an arrangement of blades and catches (not shown). Furthermore, a mechanical opener 25, which is possibly electrically controlled by a control 25*a*, may be provided to facilitate the opening and closing of the panels 24.

Preferably disposed throughout the structure of the protective device 4 are a number of viewing windows 26. The viewing windows 26 may be placed in such a manner that a clear view is afforded of each of the more important operational areas of the printing units 2. Additionally, a number of swivellable hatches 28 are preferably provided within the structure of the protective device 18 in order to allow localized access to any of the more important operational or maintenance areas of the printing units 14. Opening and closing of the hatches 28 is also preferably actuated by a mechanical opener 29, which opener may be electrically controlled by a control 29*a*.

The swivellable panels 24, when disposed in a closed position, are preferably sealed to the support members 22 with gaskets 30. Such an arrangement of gaskets 30 is preferably provided in order to minimize leakage of solvent fumes from within the protective device 18. The ventilation unit 20 is therefore able to retrieve a larger quantity of the solvent fumes produced by the printing units 14 than would be possible if appreciable leakage transpired through the edges of the swivellable panels 24. It should be noted that the ventilation unit 20 may comprise the air recirculation system 32, which system may have the dual capability of removing solvent fumes from within the protective device and returning to the protective device a quantity of cooler and drier air. The hatches 28, when disposed in a closed position, may also be sealed with gaskets 30.

Figure 3:
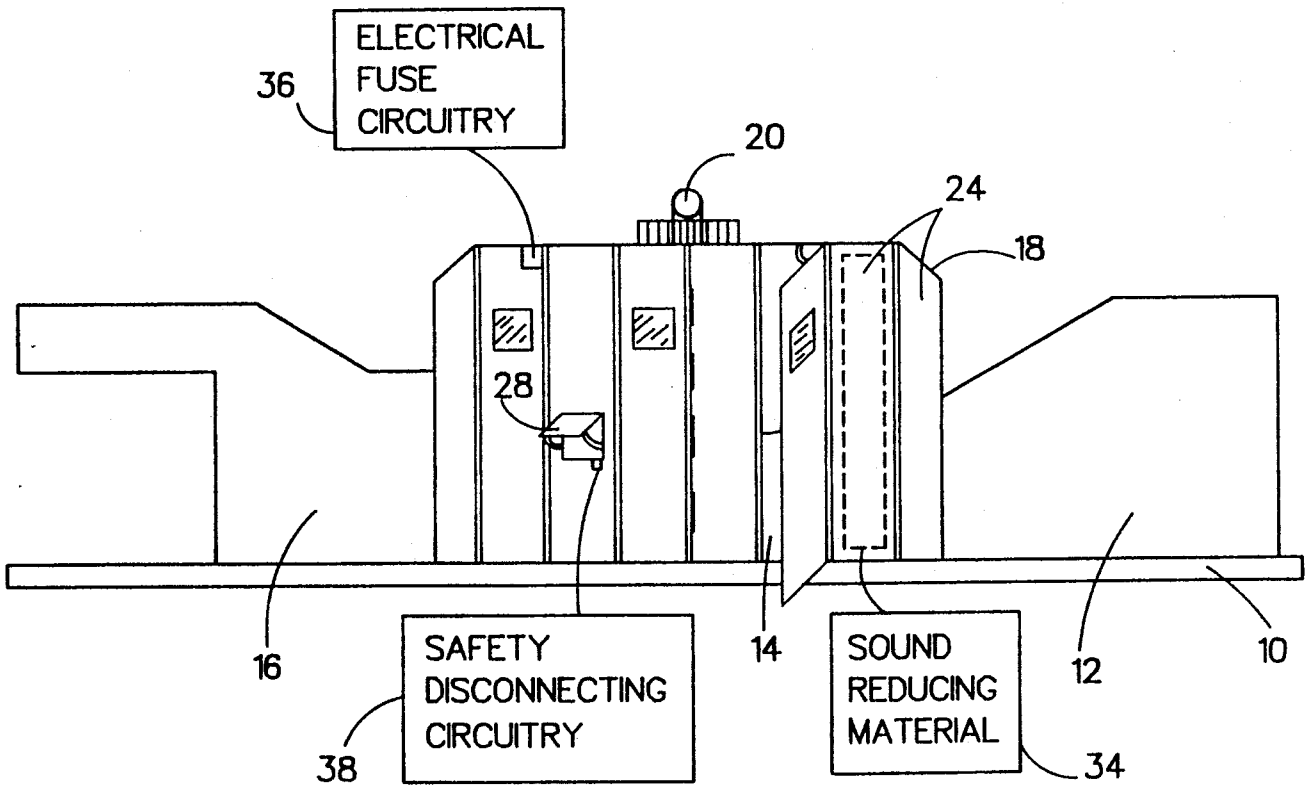
FIG. 3 is substantially the same view as FIGS. 1, 1*a* and 2, but showing in detail an additional set of components disposed upon the protective device.

It should be apparent that the protective device 18, by virtue of its capsular structure, should be sufficient for reducing a considerable quantity of noise produced by the printing units 14 therewithin. Referring now to FIG. 3, in a preferred embodiment of the invention, the protective device 18 may additionally comprise a quantity of sound-reducing, or soundproofing material 34 disposed thereupon. Such soundproofing material 34 may comprise a plurality of sheets affixed to the inner surface of each swivellable panel 24. It should also be noted that, in a preferred embodiment of the present invention, the sides of the protective device are substantially disposed upon the floor 10 of the print shop. It should therefore be noted that a further reduction in the noise level produced by the printing units 14 may be afforded by a considerable conductance of sound through the solid material of the protective device 18 to the print shop floor 10 physically interfaced therebeneath.

Finally, it should be noted that at least part of the structure of the protective device 18 is preferably provided with, and therefore protected by, electrical fuse circuitry 36. Alternatively, an arrangement of safety disconnection circuitry 38 may be provided to automatically shut down any or all of the printing units 14 upon the opening of one of the panels 24 or hatches 28.

Some examples of soundproofing material may be found in U.S. Pat. No. 3,876,034 to Antonini, entitled "Soundproof Panel"; U.S. Pat. No. 4,832,147 to Dear, Ingard, and Scheinberg, entitled "Sound Reduction Membrane"; and U.S. Pat. No. 4,463,049 to Perret, entitled "Sound Absorbing Wall Lining".

Examples of ventilation units may be found in U.S. Pat. No. 4,714,010 to Smart, entitled "Industrial Exhaust Ventilation System" and U.S. Pat. No. 4,846,852 to Schweitzer, Golde, and Mathews, entitled "Method and Apparatus for Separating and Recovering Volatile Solvents from Exhaust Air". Additionally, an example of a ventilation unit which comprises an air recirculation system may be found in U.S. Pat. No. 4,479,814, entitled "Recirculation Regeneration".

Examples of electrical fuse circuits may be found in U.S. Pat. No. 4,893,106 to Goldstein, Howton and Jones, entitled "Electrical Fuses"; and U.S. Pat. No. 4,937,699 to Polgreen, entitled "Frequency Dependent Fuse for a Telephone Circuit or the Like". Additionally, an example of interlocking circuits may be found in U.S. Pat. No. 4,000,693 to Kaiser and Abendroth, entitled "Safe Access Arrangement for Driven Mechanisms in a Printing Press".

Examples of devices for mechanically and/or electrically opening a panel or hatch may be found in U.S. Pat. No. 4,621,454 to Halstead, entitled "Mechanism for Controllably Opening and Closing Appliance Door or Panel"; U.S. Pat. No. 4,631,461 to Michel Peugeot; and U.S. Pat. No. 4,502,726 to Adams, entitled "Control Apparatus for Pivotal-Sliding Roof Assembly".

Examples of gaskets may be found in U.S. Pat. No. 4,541,203 to Naffrechoux and Delfosse, entitled "Oven Door Gasket"; and U.S. Pat. No. 4,250,865 to Scherer, entitled "Easy Access Oven Control Panel and Panel Seal".

An example of an access cover or hatch may be found in U.S. Pat. No. 4,854,233 to Despot and Krober, entitled "Protective Device on Rotary Printing Presses".

An example of a safety device for a sheet-fed rotary press may be found in U.S. Pat. No. 4,669,380 to Seib and Emrich, entitled "Safety Device for a Sheet-fed Rotary Press".

Finally, an example of an arrangement allowing for eased access to a printing machine may be found in U.S. Pat. No. 4,711,172, entitled "Machine Having a Plurality of Working Stations for Successively Processing a Sheet of Material Running through the Machine".

In summary, one feature of the invention resides broadly in a protective device for offset rotary printing machines, in particular for printing units of sheet-fed rotary printing machines, with a sheet-like protective covering of the danger points, which is positioned so that it can be removed for adjustment and maintenance work and is protected by electrical fuse circuits, characterized by the fact that the protective device 18 surrounds the printing units 14 in capsule form, and that the protective device 18 can be totally or partially opened in order to carry out adjustment or maintenance work.

Another feature of the invention resides broadly in a protective device characterized by the fact that the walls of the protective device 18 are made of sound-reducing material.

Yet another feature of the invention resides broadly in a protective device characterized by the fact that the protective device 18 is formed of a number of individual elements, which are mounted so that they can be moved or swivelled against one another.

A further feature of the invention resides broadly in a protective device characterized by the fact that the individual elements are sealed by means of gaskets in the closed state.

A yet further feature of the invention resides broadly in a protective device characterized by the fact that the capsule-form protective device 18 is mounted so that it can be lifted off or swivelled.

Yet another feature of the invention resides broadly in a protective device characterized by the fact that the capsule-form protective device 18 as a whole, and/or its individual elements, is protected by electrical fuse circuits.

An additional feature of the invention resides broadly in a protective device characterized by the fact that the capsule-form protective device 18 is provided with an extraction device 20.

A yet additional feature of the invention resides broadly in a protective device characterized by the fact that the capsule-form protective device 18 is provided with a recirculation system 32.

A further additional feature of the invention resides broadly in a protective device characterized by the fact that the walls of the protective device 18 are provided with window-like, glazed openings.

A yet further additional feature of the invention resides broadly in a protective device characterized by the fact that electrical or mechanical means of force act on the capsule-form protective device 18 and/or on the individual elements in order to open or close the elements.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A protective covering for an offset rotary printing machine, wherein the printing machine has at least one printing unit; at least one of said at least one printing unit comprising: print media feeding means for feeding print media to at least one of said at least one printing unit, support frame means for housing at least one of said at least one printing unit, an ink duct roller for providing ink to at least one of said at least one printing unit, at least one blanket cylinder and at least one impression cylinder, means for transferring ink between said ink duct roller and said at least one blanket cylinder, said ink duct roller, said means for transferring ink, said at least one blanket cylinder and said at least one impression cylinder being mounted for rotation within said support frame means, and sheet conveyor means for transporting the print media out of at least one of said at least one printing unit;

said protective covering being provided for covering at least some danger areas of the at least one printing unit;

said protective covering comprising substantially flat surfaces;

said protective covering for being removable for adjustment and maintenance work;

said protective covering surrounding the at least one printing unit for substantially encapsulating the at least one printing unit;

said protective covering being protected by at least one of:

safety disconnecting circuitry means for disconnecting electric power to the printing machine; and electrical fuse circuitry means;

said protective covering having means for at least partially opening said protective covering for carrying out adjustment and maintenance work on the at least one printing unit;

said protective covering having a plurality of sides;

said sides of said protective covering comprising sound-absorbing material;

at least one of said plurality of displaceable structural elements having a closed position;

at least one of said plurality of displaceable structural elements having sealing means;

at least one of said plurality of displaceable structural elements having said sealing means being sealed by said sealing means while in said closed position;

said protective covering comprising means for being displaceable relative to said at least one printing unit;

said protective covering comprising ventilation means;

said ventilation means being disposed upon said protective covering;

said ventilation means comprising air recirculation means;

said protective covering including viewing means for viewing at least part of the at least one printing unit;

said viewing means being disposed in at least said sides of said protective covering;

said protective covering having displacement means for displacing at least one of said plurality of structural elements;

said protective covering having at least one opening;

said at least one opening having hatch means disposed adjacent thereto;

said protective covering having displacement means for displacing said hatch means;

said displacement means for displacing said at least one of said plurality of structural elements comprising at least one of: hand-powered displacement means, mechanically powered displacement means and electrically powered displacement means;

said displacement means for displacing said hatch means comprising at least one of: hand-powered displacement means, mechanically powered displacement means and electrically powered displacement means;

said ventilation means comprising means for extracting vapors from the at least one printing unit;

said air recirculation means comprising means for returning air from said means for extracting to within said protective covering;

said protective covering comprising at least one surface;

said protective covering comprising means for affixing said sound-absorbing material to at least one of said at least one surface;

said sealing means comprising at least one gasket about at least one of: said hatch means and said at least one structural element; and said sound-absorbing material comprising a sound-absorbing lining.

2. The protective covering according to claim 1, wherein:

said protective covering comprises a plurality of structural elements;

at least one of said plurality of structural elements is displaceable relative to at least another of said plurality of structural elements; and at least one of said plurality of structural elements is swivellable relative to at least another of said plurality of structural elements.

3. The protective covering according to claim 2, further comprising: at least one of said structural elements being protected by at least one of: said electrical fuse circuitry means and said safety disconnecting circuitry means;

said at least one gasket comprising:

a first gasket and a second gasket;

at least one of said at least one sliding panel being disposed between said first gasket and said second gasket when said at least one of said at least one sliding panel is in said second, closed position;

a connection strip connected to each of said first gasket and said second gasket for connecting said first gasket and said second gasket;

said connection strip being disposed about at least one of said at least one sliding panel when said at least one of said at least one sliding panel is in said second, closed position;

said connection strip comprising adhesive for being affixed to at least a portion of each of said first gasket and said second gasket;

said connection strip comprising at least one vapor impermeable layer for substantially containing the vapors from the at least one printing unit.

4. Offset rotary printing machine having a plurality of printing units and having a protective covering of at least some danger areas of said printing units, said offset rotary printing machine being disposed on a floor of a print shop, said offset rotary printing machine comprising:

print media feeding means for feeding print media to said printing units;

sheet conveyor means for transporting the print media out of said printing units;

each said printing unit comprising:

support frame means for housing said printing unit;

at least one ink duct roller for providing ink to said printing unit;

at least one blanket cylinder and at least one impression cylinder;

means for transferring ink between said at least one ink duct roller and said at least one blanket cylinder; and said ink duct roller, said means for transferring ink, said at least one blanket cylinder and said at least one impression cylinder being mounted for rotation within said support frame means;

said protective covering comprising a plurality of substantially flat surfaces;

said protective covering for being removable for adjustment and maintenance work;

said protective covering surrounding said printing units and substantially encapsulating said printing units;

means for at least partially opening said protective covering for carrying out adjustment and maintenance work on said printing units;

said protective covering having a plurality of sides;

said sides of said protective covering comprising sound-absorbing material;

said sides of said protective covering being disposed on the floor of the print shop;

said protective covering being protected by at least one of:

safety disconnecting circuitry means for disconnecting electric power to said printing machine; and electrical fuse circuitry means;

at least one of said plurality of displaceable structural elements having a closed position;

at least one of said plurality of structural elements having sealing means;

at least one of said plurality of structural elements having said sealing means being sealed by said sealing means while in said closed position;

said protective covering comprising means for being displaceable relative to said printing units;

said protective covering comprising ventilation means;

said ventilation means being disposed upon said protective covering;

said ventilation means comprising air recirculation means;

said protective covering including viewing means for viewing at least part of said printing units;

said viewing means being disposed in at least said sides of said protective covering;

said protective covering having displacement means for displacing at least one of said plurality of structural elements;

said protective covering having at least one opening;

said displacement means for displacing said at least one of said plurality of structural elements comprising at least one of: hand-powered displacement means, mechanically powered displacement means and electrically powered displacement means;

said displacement means for displacing said hatch means comprising at least one of: hand-powered displacement means, mechanically powered displacement means and electrically powered displacement means;

said ventilation means comprising means for extracting vapors from said printing units;

said protective covering comprising at least one surface; said protective covering comprising means for affixing said sound-absorbing material to at least one of said at least one surface;

said sealing means comprising at least one gasket about at least one of: said hatch means and said at least one structural element;

said sound-absorbing material comprising a sound-absorbing lining;

said protective covering comprising a plurality of structural elements;

at least one of said plurality of structural elements being displaceable relative to at least another of said plurality of structural elements;

at least one of said plurality of structural elements being swivellable relative to at least another of said plurality of structural elements;

at least one of said structural elements being protected by at least one of: said electrical fuse circuitry means and said safety disconnecting means;

said at least one opening having hatch means disposed adjacent thereto;

said protective covering having displacement means for displacing said hatch means;

said air recirculation means comprising means for returning air from said means for extracting to within said protective covering;

said at least one gasket comprising:

a first gasket and a second gasket;

at least one of said at least one sliding panel being disposed between said first gasket and said second gasket when said at least one of said at least one sliding panel is in said second, closed position;

a connection strip connected to each of said first gasket and said second gasket for connecting said first gasket and said second gasket;

said connection strip being disposed about at least one of said at least one sliding panel when said at least one of said at least one sliding panel is in said second, closed position;

said connection strip comprising adhesive for being affixed to at least a portion of each of said first gasket and said second gasket; and said connection strip comprising at least one vapor impermeable layer for substantially containing the vapors from said printing units.

5. Offset rotary printing machine having: at least one printing unit; and a protective covering, having a plurality of sides and at least one surface, being provided for covering at least some danger areas of the at least one printing unit;

at least one of said at least one printing unit comprising:

print media feeding means for feeding print media to at least one of said at least one printing unit;

support frame means for housing at least one of said at least one printing unit;

an ink duct roller for providing ink to at least one of said at least one printing unit;

at least one blanket cylinder and at least one impression cylinder;

means for transferring ink between said ink duct roller and said at least one blanket cylinder;

said ink duct roller, said means for transferring ink, said at least one blanket cylinder and said at least one impression cylinder being mounted for rotation within said support frame means; and sheet conveyor means for transporting the print media out of at least one of said at least one printing unit;

said protective covering comprising:

said protective covering for surrounding the at least one printing unit for substantially encapsulating said at least one printing unit;

said protective covering for being removable for adjustment and maintenance work on said at least one printing unit;

means for displacing said protective covering relative to said at least one printing unit;

means for at least partially opening said protective covering for carrying out adjustment and maintenance work on said at least one printing unit;

a plurality of displaceable structural elements;

means for displacing at least one of said plurality of structural elements;

said means for displacing said at least one of said plurality of structural elements comprising at least one of: hand-powered displacement means, mechanically powered displacement means and electrically powered displacement means;

at least one of said plurality of displaceable structural elements having a closed position;

at least one of said plurality of displaceable structural elements having sealing means;

at least one of said plurality of displaceable structural elements having said sealing means being sealed by said sealing means while in said closed position;

said sealing means comprising at least one gasket disposed about at least one of said plurality of structural elements;

the sides of said protective covering comprising sound-absorbing material;

means for affixing said sound-absorbing material to at least one of the at least one surface of said protective covering;

said sound-absorbing material comprising a sound-absorbing lining;

said protective covering being protected by at least one of:

safety disconnecting circuitry means for disconnecting electric power to said printing machine; and electrical fuse circuitry means;

ventilation means being disposed upon said protective covering, said ventilation means comprising means for extracting vapors from the at least one printing unit;

viewing means for viewing at least part of the at least one printing unit, said viewing means being disposed in at least the sides of said protective covering;

said ventilation means comprising air recirculation means;

at least one of said plurality of structural elements being displaceable relative to at least another of said plurality of structural elements;

at least one of said said plurality of structural elements being swivellable relative to at least another of said plurality of structural elements;

at least one of said structural elements being protected by at least one of: said electrical fuse circuitry means and said safety disconnecting circuitry means;

said protective covering including viewing means for viewing at least part of said at least one printing unit;

said viewing means being disposed in at least said sides of said protective covering;

said protective covering having at least one opening;

said at least one opening having hatch means disposed adjacent thereto;

said protective covering having displacement means for displacing said hatch means;

said displacement means for displacing said hatch means comprising at least one of: hand-powered displacement means, mechanically powered displacement means and electrically powered displacement means;

said air recirculation means comprising means for returning air from said means for extracting to within said protective covering;

said at least one gasket comprising:

a first gasket and a second gasket;

at least one of said at least one sliding panel being disposed between said first gasket and said second gasket when said at least one of said at least one sliding panel is in said second, closed position;

a connection strip connected to each of said first gasket and said second gasket for connecting said first gasket and said second gasket;

said connection strip being disposed about at least one of said at least one sliding panel when said at least one of said at least one sliding panel is in said second, closed position;

said connection strip comprising adhesive for being affixed to at least a portion of each of said first gasket and said second gasket; and said connection strip comprising at least one vapor impermeable layer for substantially containing the vapors from said at least one printing unit.

6. The protective covering according to claim 5, wherein said protective covering has at least one opening;

said at least one opening has hatch means disposed thereupon; and said protective covering has displacement means for displacing said hatch means.

7. The protective covering according to claim 5, wherein at least one of said plurality of structural elements is displaceable relative to at least another of said plurality of structural elements.

8. The protective covering according to claim 7, wherein said at least one of said plurality of structural elements is swivellable relative to at least another of said plurality of structural elements.

9. The protective covering according to claim 7, further comprising:

at least one of said structural elements being protected by said electrical fuse circuitry means; and at least one of said structural elements being protected by said safety disconnecting circuitry means.

* * * * *